US006391534B1

(12) United States Patent
Maskasky et al.

(10) Patent No.: US 6,391,534 B1
(45) Date of Patent: May 21, 2002

(54) PREPARATION OF HIGH BROMIDE PHOTOGRAPHIC EMULSIONS WITH STARCH PEPTIZER AND OXIDIZING AGENT

(75) Inventors: Joe E. Maskasky; Victor P. Scaccia, both of Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/731,445

(22) Filed: Dec. 7, 2000

(51) Int. Cl.[7] ..... G03C 1/085; G03C 1/494

(52) U.S. Cl. ..... 430/567; 430/569; 430/639; 430/641

(58) Field of Search ..... 430/567, 569, 430/639, 641

(56) References Cited

U.S. PATENT DOCUMENTS

| | | | | | |
|---|---|---|---|---|---|
| 5,284,744 | A | | 2/1994 | Maskasky | |
| 5,411,853 | A | * | 5/1995 | Maskasky | 430/569 |
| 5,604,085 | A | | 2/1997 | Maskasky | |
| 5,620,840 | A | | 4/1997 | Maskasky | |
| 5,667,955 | A | | 9/1997 | Maskasky | |
| 5,691,131 | A | | 11/1997 | Maskasky | |
| 5,693,459 | A | | 12/1997 | Maskasky | |
| 5,726,008 | A | | 3/1998 | Maskasky | |
| 5,733,718 | A | | 3/1998 | Maskasky | |
| 5,763,151 | A | * | 6/1998 | Brust et al. | 430/569 |
| 5,804,363 | A | * | 9/1998 | Maskasky et al. | 430/567 |
| 6,027,869 | A | | 2/2000 | Maskasky et al. | |
| 6,090,536 | A | | 7/2000 | Maskasky et al. | |
| 6,100,019 | A | * | 8/2000 | Brust et al. | 430/569 |
| 6,187,525 | B1 | * | 2/2001 | Maskasky et al. | 430/567 |
| 6,225,036 | B1 | * | 5/2001 | Maskasky et al. | 430/567 |

OTHER PUBLICATIONS

"Das Redoxverhalten des latenten Innenbildes", R. Matejec and E. Moisar, (with English translation, "The redox behavior of the latent interior image"), Photographische Korrespondenz, vol. 101 (4), 1965, pp. 53–60.

T. Tani, "Photographic Effects Of Electron And Positive Hole Traps In Silver Halides", Photographic Science And Engineering, vol. 15, No. 3, May–Jun. 1971, pp. 181–188.

Proy L. Whistler and Richard Schweiger, "Oxidation Of Amylopectin With Hypochlorite At Different Hydrogen Ion Concentrations", J. Am. Chem. Soc., vol. 79, pp. 6460–6464, 1957.

K. F. Patel, H. U. Mehta, and H. C. Srivastava, "Kinetics And Mechanism Of Oxidation Of Starch With Sodium Hypochlorite", Journal of Applied Polymer Science, vol. 18, p. 289–399, 1974.

Jehudah Eliassaf and Jeanine Bel–Aychne, "The Interaction Of Starch With Bromine In Acid Solution", Carbohydrate Research, vol. 5, pp. 470–476, 1967.

B. Perlmutter–Hayman and Y. Weissmann, "The Kenetics Of Ethanol And Of Acetaldehyde By Bromine In Aqueous Solution", J. Am. Chem. Soc. vol. 84, pp. 2323–2326, 1962.

B. Perlmutter–Hayman and A. Persky, "The Kenetics Of The Oxidation Of D–Glucose By Bromine And By Hypobromous Acid", J. Am. Chem. Soc. vol. 82, pp. 276–279, 1960.

B. Perlmutter–Hayman and A. Persky, "The Influence Of Ionic Strength And Of Temperature On The Rate Of Oxidation Of D–Glucose By Bromine", J. Am. Chem. Soc. vol. 82, pp. 3809–3810, 1960.

* cited by examiner

*Primary Examiner*—Geraldine Letscher
(74) *Attorney, Agent, or Firm*—Andrew J. Anderson

(57) ABSTRACT

A process for precipitating a high bromide silver halide emulsion in an aqueous medium is described comprising precipitating high bromide radiation-sensitive silver halide grains in a reaction vessel in the presence of a peptizer comprising a water dispersable starch, wherein a strong oxidizing agent is added to the reaction vessel during or after the precipitation at a pH of less than 4.0 such that an oxidation potential of at least 650 mV (Ag/AgCl ref.) is achieved. A reduction in the rate of reaction between strong oxidants such as bromine and starch at such low pH has been found to enable an advantageous decrease in the amount of oxidant required to achieve and maintain a high oxidation potential during emulsion grain precipitation. Starch, unlike gelatin, also advantageously has adequate stability at the combination of high acidity and high emulsion precipitation temperatures.

28 Claims, No Drawings

PREPARATION OF HIGH BROMIDE PHOTOGRAPHIC EMULSIONS WITH STARCH PEPTIZER AND OXIDIZING AGENT

FIELD OF THE INVENTION

The invention relates to silver halide photography. More specifically, the invention relates to radiation-sensitive high bromide emulsions prepared in the presence of starch peptizer and photographic elements employing such emulsions.

BACKGROUND OF THE INVENTION

The most widely used forms of photographic elements are those that contain one or more silver halide emulsions. Silver halide emulsions are usually prepared by precipitating silver halide in the form of discrete grains (microcrystals) in an aqueous medium. An organic peptizer is incorporated in the aqueous medium to disperse the grains. Varied forms of hydrophilic colloids are known to be useful as peptizers, but the overwhelming majority of silver halide emulsions employ gelatino-peptizers. A summary of conventional peptizers, including gelatino-peptizers, is provided by *Research Disclosure*, Vol. 389, September 1996, Item 38957, II. Vehicles, vehicle extenders, vehicle-like addenda and vehicle related addenda, A. Gelatin and hydrophilic colloid peptizers. *Research Disclosure* is published by Kenneth Mason Publications, Ltd., Dudley House, 12 North St., Emsworth, Hampshire P010 7DQ, England. The term "vehicle" includes both the peptizer used to disperse silver halide grains as they are being formed and the binder used in coating emulsion and processing solution penetrable layers of photographic elements. Gelatin and gelatin derivatives are commonly employed to perform the functions of both peptizer and binder. While gelatin is by far the most widely used peptizer in the photographic emulsion arts, it has been shown that water dispersable starches may also be used as a peptizer to make silver halide emulsion grains (U.S. Pat. No. 5,284,744).

A dramatic increase in photographic speeds in silver halide photography began with the introduction of tabular grain emulsions into silver halide photographic products in 1982. A tabular grain is one which has two parallel major faces that are clearly larger than any other crystal face and which has an aspect ratio of at least 2. The term "aspect ratio" is the ratio of the equivalent circular diameter (ECD) of the grain divided by its thickness (the distance separating the major faces). Tabular grain emulsions are those in which tabular grains account for greater than 50 percent of total grain projected area. Kofron et al U.S. Pat. No. 4,439,520 illustrates the first chemically and spectrally sensitized high aspect ratio (average aspect ratio >8) tabular grain emulsions. In their most commonly used form tabular grain emulsions contain tabular grains that have major faces lying in {111} crystal lattice planes and contain greater than 50 mole percent bromide, based on silver. A summary of tabular grain emulsions is contained in *Research Disclosure*, Item 38957, cited above, I. Emulsion grains and their preparation, B. Grain morphology, particularly sub-paragraphs (1) and (3).

Pushing starch made emulsions towards high speed has been hampered by difficulties in making large tabular grain sizes. The use of less grain-growth-restraining cationic starches as a peptizer for the precipitation of high bromide {111} tabular grain emulsions has addressed such difficulty, as taught by Maskasky U.S. Pat. Nos. 5,604,085, 5,620,840, 5,667,955, 5,691,131, and 5,733,718. Under comparable levels of chemical sensitization for high bromide {111} tabular grain emulsions, higher photographic speeds can be realized using cationic starch peptizers as taught by such patents. Alternatively, speeds equal to those obtained using gelatino-peptizers can be achieved at lower sensitization temperatures, thereby avoiding unwanted grain ripening. The use of oxidized cationic starches are particularly advantageous in exhibiting lower levels of viscosity than gelatino-peptizers, which facilitates mixing.

It has also been observed that employing a starch peptizer for emulsion grain precipitation may result in somewhat higher minimum densities (i.e., fog) than when a gelatino-peptizer is substituted, even when conventional antifoggants and stabilizers are present in the emulsion. It is likely a result of silver reduction by the starch aldehyde groups. This type of reduction is well known and is the basis for a test for aldehyde groups at ammonium hydroxide pH known as the Tollens' test or "silver mirror" test:

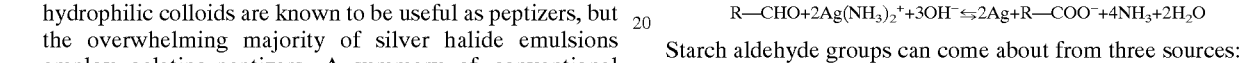

$$R—CHO+2Ag(NH_3)_2^{+}+3OH^{-} \leftrightharpoons 2Ag+R—COO^{-}+4NH_3+2H_2O$$

Starch aldehyde groups can come about from three sources: (1) starch, being a polymer of glucose, a reducing sugar, has a natural aldehyde group at one end of each polymer strand, (2) hydrolysis of a polymer strand would make a new terminal aldehyde group in addition to the previous aldehyde group, and (3) partial oxidation of a C—C bond in the glucopyranose ring can create two new aldehyde groups at the carbon bond scission point.

Fog may be reduced in starch precipitated emulsions by treating the emulsion (either during or after precipitation) with an oxidizing agent as disclosed, e.g., in U.S. Pat. Nos. 6,027,869 and 6,090,536, where the oxidizing agent establishes an oxidation potential capable of oxidizing metallic silver. Specifically preferred oxidizing agents employed during the preparation of high bromide emulsions precipitated with starch peptizers are halogens, e.g., bromine ($Br_2$) or iodine ($I_2$), and bromine or iodine generating agents. Elemental bromine and bromine-generating agents (such as an acidified solution of sodium hypochlorite containing sodium bromide) have been found to be particularly effective oxidants. When bromine or iodine is used as an oxidizing agent, the bromine or iodine is reduced to $Br^-$ or $I^-$. These halide ions can simply remain with other excess halide ions in the dispersing medium of the emulsion or be incorporated within the high bromide grains without adversely influencing photographic performance.

The reaction of starch and oxidizing agents such as bromine at typically pH values conventionally used for gelatin peptized emulsions can also rapidly deplete the oxidizing agent, however, requiring the frequent addition of relatively high levels of oxidant to maintain desired high oxidation potentials sufficient for bleaching internal grain fog centers. Health concerns have arisen concerning the handling and generation of significant amounts of volatile halides during emulsion grain manufacture. Accordingly, it would be desirable to provide an emulsion grain precipitation process employing starch peptizer which would enable a reduction in the amount of volatile halides such as bromine which are added to or generated in an emulsion precipitation reaction vessel, and more preferably to completely eliminate the need to handle or add such volatile halides directly to the vessel, while still reducing fog generation in the precipitated emulsion grains.

SUMMARY OF THE INVENTION

In one aspect, this invention is directed to a process for precipitating a high bromide silver halide emulsion in an aqueous medium comprising precipitating high bromide radiation-sensitive silver halide grains in a reaction vessel in the presence of a peptizer comprising a water dispersable starch, wherein a strong oxidizing agent is added to the reaction vessel during or after the precipitation at a pH of less than 4.0 such that an oxidation potential of at least 650 mV (Ag/AgCl ref.) is achieved. An unexpectedly significant reduction in the rate of reaction between strong oxidants such as bromine and starch at such low pH has been found to enable an advantageous decrease in the amount of oxidant required to achieve and maintain a high oxidation potential during emulsion grain precipitation. Starch, unlike gelatin, also advantageously has adequate stability at the combination of high acidity and high emulsion precipitation temperatures.

DETAILED DESCRIPTION OF THE INVENTION

The present invention is generally applicable to the precipitation of high bromide silver halide emulsions carried out by the reaction of soluble halide salt and a soluble silver salt in the presence of water-dispersable starch as a peptizer. The term high bromide is used to define a silver halide emulsion comprising at least 50 (preferably 70 and optimally 90) mole percent bromide, based on silver, with any remaining halide being bromide, chloride, or mixtures thereof. Iodide can be present in levels up to saturation, but is preferably limited to less than 20 (optimally less than 12) mole percent, based on silver. Silver bromide, chlorobromide, iodochlorobromide, chloroiodobromide and iodobromide emulsions are contemplated. Any form of starch can be used as a peptizer providing that it is water-dispersable in the concentrations necessary to provide protection of the grains from coalescence or flocculation.

The term "starch" is employed to include both natural starch and modified derivatives, such as dextrinated, hydrolyzed, alkylated, hydroxyalkylated, acetylated or fractionated starch. The starch can be of any origin, such as corn starch, wheat starch, potato starch, tapioca starch, sago starch, rice starch, waxy corn starch or high amylose corn starch. Illustrations of varied types of starch are set out by Whistler et al *Starch Chemistry and Technology*, $2^{nd}$ Ed., Academic Press, 1984. Starches are generally comprised of two structurally distinctive polysaccharides, α-amylose and amylopectin. Both are comprised of α-D-glucopyranose units. In α-amylose the α-D-glucopyranose units form a 1,4-straight chain polymer. The repeating units take the following form:

(I)

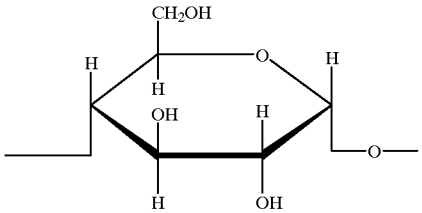

In amylopectin, in addition to the 1,4-bonding of repeating units, 6-position chain branching (at the site of the —$CH_2OH$ group above) is also in evidence, resulting in a branched chain polymer. The repeating units of starch and cellulose are diasteroisomers that impart different overall geometries to the molecules. The α anomer, found in starch and shown in formula I above, results in a polymer that is capable of crystallization and some degree of hydrogen bonding between repeating units in adjacent molecules, but not to the same degree as the β anomer repeating units of cellulose and cellulose derivatives. Polymer molecules formed by the β anomers show strong hydrogen bonding between adjacent molecules, resulting in clumps of polymer molecules and a much higher propensity for crystallization. Lacking the alignment of substituents that favors strong intermolecular bonding, found in cellulose repeating units, starch and starch derivatives are much more readily dispersed in water.

To be useful as a peptizer the starch must be water dispersible. Many starches disperse in water upon heating to temperatures up to boiling for a short time (e.g., 5 to 30 minutes). High sheer mixing also facilitates starch dispersion. The presence of ionic substituents increases the polar character of the starch molecule and facilitates dispersion. The starch molecules preferably achieve at least a colloidal level of dispersion and ideally are dispersed at a molecular level—i.e., dissolved.

The conventional procedures for the precipitation of radiation-sensitive silver halide emulsions employing organic peptizers, such as gelatin, gelatin derivative, starch and cellulose derivative peptizers, modified only by the substitution of starch in like amounts for the conventional peptizer and introduction of a strong oxidizing agent to the emulsion at low pH, can be employed in the practice of the invention. Grain nucleation and subsequent growth during the precipitation process may occur in the same or separate reaction vessels. In the context of the preparation of emulsions the term "nucleation" refers to that stage of the precipitation or preparation process in which stable new silver halide grains are being formed or otherwise introduced into the reaction vessel. The term "growth" refers to that portion of the precipitation or preparation process in which existing silver halide grains are being increased in size in the reaction vessel. Growth of existing grains may occur with or without an additional stable grain population being introduced or formed, resulting in relatively polydisperse or monodisperse emulsion grain sizes. A summary of conventional emulsion precipitations can be found in *Research Disclosure*, Item 36544, cited above, Section I, Emulsion grains and their preparation. Starch peptizer concentrations of from 0.1 to 10 percent, by weight, more preferably 0.5 to 4 percent, based on the total weight of emulsion as prepared by precipitation, can typically be employed. Mixtures of water-dispersable starches are also contemplated as peptizers within the invention as equivalent to starch from a single source.

High bromide emulsions prepared in accordance with the invention can include coarse, medium or fine silver halide grains and can be prepared by a variety of techniques, e.g., single-jet, double-jet (including continuous removal techniques) accelerated flow rate and interrupted precipitation techniques. Emulsion grains prepared in accordance with the invention can vary in size from Lippmann sizes up to the largest photographically useful sizes. For tabular grain emulsions, average maximum useful sizes range up to equivalent circular diameters (ECD's) of 10 μm. However, tabular grains rarely have average ECD's in excess of 5 μm. Nontabular grains seldom exhibit grain sizes in excess of 2 μm. Emulsions having different grain sizes and halide compositions can of course be blended to achieve desired effects.

In the preparation of silver halide emulsions other than tabular grain emulsions, the starch peptizer can be cationic, anionic or non-ionic. It is preferred, however, in connection with silver halide grain precipitation generally, and typically necessary in preparing tabular grain emulsions, to employ a water dispersible starch or derivative as a peptizer that is cationic, i.e., that contains an overall net positive charge when dispersed in water. Starches are conventionally rendered cationic by attaching a cationic substituent to at least a portion of the (α-D-glucopyranose units, usually by esterification or etherification at one or more free hydroxyl sites. Reactive cationogenic reagents typically include a primary, secondary or tertiary amino group (which can be subsequently protonated to a cationic form under the intended conditions of use) or a quaternary ammonium, sulfonium or phosphonium group.

The following teachings, the disclosures of which are here incorporated by reference, illustrate water dispersible cationic starches within the contemplation of preferred embodiments of the invention:

*Rutenberg et al U.S. Pat. No. 2,989,520;
Meisel U.S. Pat. No. 3,017,294;
Elizer et al U.S. Pat. No. 3,051,700;
Aszolos U.S. Pat. No. 3,077,469;
Elizer et al U.S. Pat. No. 3,136,646;
*Barber et al U.S. Pat. No. 3,219,518;
*Mazzarella et al U.S. Pat. No. 3,320,080;
Black et al U.S. Pat. No. 3,320,118;
Caesar U.S. Pat. No. 3,243,426;
Kirby U.S. Pat. No. 3,336,292;
Jarowenko U.S. Pat. No. 3,354,034;
Caesar U.S. Pat. No. 3,422,087;
*Dishburger et al U.S. Pat. No. 3,467,608;
*Beaninga et al U.S. Pat. No. 3,467,647;
Brown et al U.S. Pat. No. 3,671,310;
Cescato U.S. Pat. No. 3,706,584;
Jarowenko et al U.S. Pat. No. 3,737,370;
*Jarowenko U.S. Pat. No. 3,770,472;
Moser et al U.S. Pat. No. 3,842,005;
Tessler U.S. Pat. No. 4,060,683;
Rankin et al U.S. Pat. No. 4,127,563;
Huchette et al U.S. Pat. No. 4,613,407;
Blixt et al U.S. Pat. No. 4,964,915;
*Tsai et al U.S. Pat. No. 5,227,481; and
*Tsai et al U.S. Pat. No. 5,349,089.

It is further preferred to employ an oxidized starch as the starch peptizer, and in particular an oxidized cationic starch. The starch can be oxidized before (*patents above) or following the addition of cationic substituents. This may be accomplished by treating the starch with a strong oxidizing agent. Both hypochlorite ($ClO^-$) or periodate ($IO_4^-$) have been extensively used and investigated in the preparation of commercial starch derivatives and are preferred. While any convenient oxidizing agent counter ion can be employed, preferred counter ions are those fully compatible with silver halide emulsion preparation, such as alkali and alkaline earth cations, most commonly sodium, potassium or calcium.

When the oxidizing agent opens the α-D-glucopyranose ring, the oxidation sites are usually at the 2 and 3 position carbon atoms forming the α-D-glucopyranose ring. The 2 and 3 position

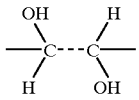

groups are commonly referred to as the glycol groups. The carbon-to-carbon bond between the glycol groups is replaced in the following manner:

(II)

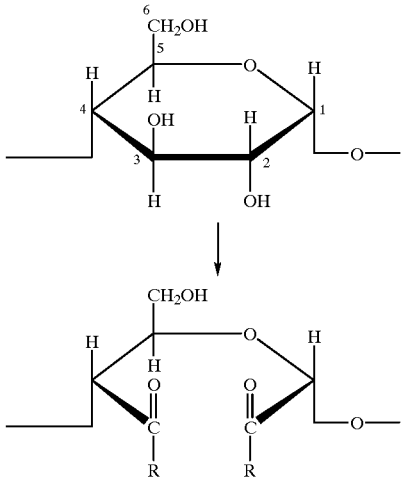

where R represents the atoms completing an aldehyde group or a carboxyl group.

The hypochiorite oxidation of starch is most extensively employed in commercial use. The hypochlorite is used in small quantities to modify impurities in starch. Any modification of the starch at these low levels is minimal, at most affecting only the polymer chain terminating aldehyde groups, rather than the α-D-glucopyranose repeating units themselves. At levels of oxidation that affect the α-D-glucopyranose repeating units the hypochlorite affects the 2, 3 and 6 positions, forming mixtures of carbonyl and carboxyl groups, i.e., aldehydes, ketones, and carboxylic acid groups. Oxidation is conducted at mildly acidic and alkaline pH (e.g., >5 to 11). The oxidation reaction is exothermic, requiring cooling of the reaction mixture. Temperatures of less than 45° C. are preferably maintained. Using a hypobromite oxidizing agent is known to produce similar results as hypochilorite.

Hypochlorite oxidation is catalyzed by the presence of bromide ions. Since silver halide emulsions are conventionally precipitated in the presence of a stoichiometric excess of the halide to avoid inadvertent silver ion reduction (fogging), it is conventional practice to have bromide ions in the dispersing media of high bromide silver halide emulsions. Thus, it is specifically contemplated to add bromide ion to the starch prior to performing the oxidation step in the concentrations known to be useful in the preparation of high bromide emulsions—e.g., up to a pBr of 3.0.

Cescato U.S. Pat. No. 3,706,584, the disclosure of which is here incorporated by reference, discloses techniques for the hypochlorite oxidation of cationic starch. Sodium bromite, sodium chlorite and calcium hypochlorite are named as alternatives to sodium hypochlorite. Further teachings of the hypochlorite oxidation of starches is provided by the following: R. L. Whistler, E. G. Linke and S. Kazeniac, "Action of Alkaline Hypochlorite on Corn Starch Amylose and Methyl 4-O-Methyl-D-glucopyranosides", *Journal Amer. Chem. Soc.*, Vol. 78, pp. 4704–9 (1956); R. L. Whistler and R. Schweiger, "Oxidation of Amylopectin with Hypochlorite at Different Hydrogen Ion Concentrations, *Journal Amer. Chem. Soc.*, Vol. 79, pp. 6460–6464 (1957); J. Schmorak, D. Mejzler and M. Lewin, "A Kinetic Study of the Mild Oxidation of Wheat Starch by Sodium Hypochloride in the Alkaline pH Range", *Journal of Polymer Science*, Vol. XLIX, pp. 203–216 (1961); J. Schmorak and M. Lewin, "The Chemical and Physico-chemical Properties of Wheat Starch with Alkaline Sodium Hypochlorite", *Journal of Polymer Science*: Part A, Vol. 1, pp. 2601–2620 (1963); K. F. Patel, H. U. Mehta and H. C. Srivastava, "Kinetics and Mechanism of Oxidation of Starch with Sodium Hypochlorite", *Journal of Applied Polymer Science*, Vol. 18, pp. 389–399 (1974); R. L. Whistler, J. N. Bemiller and E. F. Paschall, *Starch: Chemistry and Technology*, Chapter X, Starch Derivatives: Production and Uses, II. Hypochlorite-Oxidized Starches, pp. 315–323, Academic Press, 1984; and O. B. Wurzburg, *Modified Starches: Properties and Uses*, III. Oxidized or Hypochlorite-Modified Starches, pp. 23–28 and pp. 245–246, CRC Press (1986). Although hypochlorite oxidation is normally carried out using a soluble salt, the free acid can alternatively be employed, as illustrated by M. E. McKillican and C. B. Purves, "Estimation of Carboxyl, Aldehyde and Ketone Groups in Hypochlorous Acid Oxystarches", *Can. J. Chem.*, Vol. 312–321 (1954).

Periodate oxidizing agents are of particular interest, since they are known to be highly selective. The periodate oxidizing agents produce starch dialdehydes by the reaction shown in the formula (II) above without significant oxidation at the site of the 6 position carbon atom. Unlike hypochlorite oxidation, periodate oxidation does not produce carboxyl groups and does not produce oxidation at the 6 position. Mehltretter U.S. Pat. No. 3,251,826, the disclosure of which is here incorporated by reference, discloses the use of periodic acid to produce a starch dialdehyde which is subsequently modified to a cationic form. Mehltretter also discloses for use as oxidizing agents the soluble salts of periodic acid and chlorine. Further teachings of the periodate oxidation of starches is provided by the following: V. C. Barry and P. W. D. Mitchell, "Properties of Periodate-oxidized Polysaccharides. Part II. The Structure of some Nitrogen-containing Polymers", *Journal Amer. Chem. Soc.*, 1953, pp. 3631–3635; P. J. Borchert and J. Mirza, "Cationic Dispersions of Dialdehyde Starch I. Theory and Preparation", *Tappi*, Vol. 47, No. 9, pp. 525–528 (1964); J. E. McCormick, "Properties of Periodate-oxidized Polysaccharides. Part VII. The Structure of Nitrogen-containing Derivatives as deduced from a Study of Monosaccharide Analogues", *Journal Amer. Chem. Soc.*, pp. 2121–2127 (1966); and O. B. Wurzburg, *Modified Starches: Properties and Uses*, III. Oxidized or Hypochlorite-Modified Starches, pp. 28–29, CRC Press (1986).

Starch oxidation by electrolysis is disclosed by F. F. Farley and R. M. Hixon, "Oxidation of Raw Starch Granules by Electrolysis in Alkaline Sodium Chloride Solution", *Ind. Eng. Chem.*, Vol. 34, pp. 677–681 (1942).

Depending upon the choice of oxidizing agents employed, one or more soluble salts may be released during the oxidation step. Where the soluble salts correspond to or are similar to those conventionally present during silver halide precipitation, the soluble salts need not be separated from the oxidized starch prior to silver halide precipitation. It is, of course, possible to separate soluble salts from the oxidized cationic starch prior to precipitation using any conventional separation technique. For example, removal of halide ion in excess of that desired to be present during grain precipitation can be undertaken. Simply decanting solute and dissolved salts from oxidized cationic starch particles is a simple alternative. Washing under conditions that do not solubilize the oxidized cationic starch is another preferred option. Even if the oxidized cationic starch is dispersed in a solute during oxidation, it can be separated using conventional ultrafiltration techniques, since there is a large molecular size separation between the oxidized cationic starch and soluble salt by-products of oxidation.

The carboxyl groups formed by oxidation take the form —C(O)OH, but, if desired, the carboxyl groups can, by further treatment, take the form —C(O)OR', where R' represents the atoms forming a salt or ester. Any organic moiety added by esterification preferably contains from 1 to 6 carbon atoms and optimally from 1 to 3 carbon atoms.

The minimum degree of oxidation contemplated for oxidized starches in accordance with preferred embodiments is that required to reduce the viscosity of the starch. It is generally accepted (see citations above) that opening an α-D-glucopyranose ring in a starch molecule disrupts the helical configuration of the linear chain of repeating units which in turn reduces viscosity in solution. It is contemplated that at least one α-D-glucopyranose repeating unit per starch polymer, on average, be ring opened in the oxidation process. As few as two or three opened α-D-glucopyranose rings per polymer has a profound effect on the ability of the starch polymer to maintain a linear helical configuration. It is generally preferred that at least 1 percent of the glucopyranose rings be opened by oxidation.

A preferred objective is to reduce the viscosity of the cationic starch by oxidation to less than four times (400 percent of) the viscosity of water at the starch concentrations employed in silver halide precipitation. Although this viscosity reduction objective can be achieved with much lower levels of oxidation, starch oxidations of up to 90 percent of the α-D-glucopyranose repeating units have been reported (Wurzburg, cited above, p. 29). A typical convenient range of oxidation ring-opens from 3 to 50 percent of the α-D-glucopyranose rings.

In substituting oxidized cationic starch for conventional organic peptizers in accordance with preferred embodiments of the invention, a few significant differences can be observed. First, whereas conventionally silver halide precipitations are conducted in the temperature range of from 30 to 90° C., in the preparation of emulsions with starch peptizers the temperature of precipitation can range down to room temperature or even below. For example, precipitation temperatures as low as 0° C. are within the contemplation of the invention. Unlike conventional peptizers such as gelatino-peptizers, oxidized cationic starch does not "set up" at reduced temperatures. That is, the viscosity of the aqueous dispersing medium containing the cationic starch remains low. Additionally, starch, unlike gelatin, also advantageously has adequate stability at the combination of high acidity and high emulsion precipitation temperatures.

Although cationic starch is a highly effective peptizer, preventing clumping of silver halide grains as they are formed and grown, use of such peptizer does not in all instances result in the formation of high bromide grains of the same shape, size and dispersity that would be formed in the presence of the replaced conventional organic peptizer. For example, cationic starch shows a much greater propensity toward the formation of grains having {111} crystal faces. This, of course, is highly advantageous in substituting cationic starch for conventional peptizers in emulsion preparations that conventionally produce grains having {111} crystal faces, such as octahedra and tabular grains, including ultrathin (<0.07 μm) tabular grains, having {111} crystal faces. However, in precipitations that require grain growth modifiers to control crystal habit, varied grain characteristics are obtained, depending upon the specific grain growth modifier present.

The effectiveness of an oxidizing agent and conditions for its use to make clean (low fog) starch peptized emulsions depends on the minimum oxidation potential required to oxidize any silver fog centers that are present. Surface image fog, if free of gold, can be removed by oxidizing solutions only a little more positive than the macroscopic electrochemical (Ag+/Ag) equilibrium potential. The oxidation of internal silver centers, however, requires significantly higher oxidation potentials than surface silver centers. In contrast to surface-image (surface-fog centers), internal-image (internal-fog centers) are surrounded by silver halide so their oxidation has to take place indirectly by and through the silver halide phase. In a study examining the oxidation of gold-free internally light fogged core-shell AgCl and AgBr cubic emulsions (R. Matejec and E. Moisar, Photogr. Korr., 101:53 (1964)), it was reported that only in the case of very positive oxidation potentials could a degradation of the internal fog be seen. To obtain maximal bleaching effect on the internal fog generally required bathing of the emulsion coatings in solutions having potentials of at least 650 mV (when converted to Ag/AgCl as reference electrode).

In accordance with the invention, a strong oxidizing agent which is capable of establishing an oxidation potential of at least 650 mV (Ag/AgCl ref.) is added to the reaction vessel during or after at least a part of the precipitation of the starch peptized high bromide emulsion grains, at relatively low pH (i.e., less than 4.0, preferably less than or equal to 3.0, more preferably less than or equal to 2.5 and most preferably less than or equal to 2.0). As explained above, such high oxidation potentials are generally sufficient to bleach internal as well as surface fog centers which may be formed during emulsion grain precipitation. While establishing a relatively low pH value is advantageous during addition of the oxidizing agent as more filly described below, extremely low pH would be expected to degrade the starch peptizer, therefore a pH value of at least 1.0 is also preferred.

Preferred oxidizing agents are those that in their reduced form have little or no impact on the performance properties of the emulsions in which they are incorporated. Strong oxidizing agents noted above to be useful in oxidizing cationic starch, such as hypochlorite ($ClO^-$) or periodate ($IO_4^-$), are specifically contemplated. Specifically preferred oxidizing agents are halogens, e.g., bromine ($Br_2$) or iodine ($I_2$), and bromine or iodine generating agents. Elemental bromine and bromine-generating agents have been found to be particularly effective oxidants when used during the preparation of high bromide emulsions precipitated with starch peptizers. One preferred bromine generating agent is an acidified solution of alkali or alkali earth hypochlorite containing sodium bromide. Another means of generating bromine is by electrolysis of a bromine ion containing solution, such as of a bromine salt solution added to the reaction vessel during grain precipitation or directly of the dispersing medium solution in the reaction vessel. When bromine or iodine is used as an oxidizing agent, the bromine or iodine is reduced to $Br^-$ or $I^-$. These halide ions can remain with other excess halide ions in the dispersing medium of the emulsion or be incorporated within the grains without adversely influencing photographic performance. It is noted that silver is typically added to an emulsion grain precipitation reaction vessel in the form of silver nitrate solution, and nitric acid is generated at acidic pH. Also, nitric acid may conveniently be used to modify the pH of the precipitation reaction vessel. While nitric acid is an oxidizing agent, at least at preferred pH of above 1.0 it will not function as a strong oxidizing agent capable of generating an oxidation potential of at least 650 mV in accordance with the invention, and the claimed invention will thus require addition of a strong oxidizing agent which is distinct from (i.e., in addition to) the generation or addition of nitric acid, such as those discussed above.

While any level of oxidizing agent can be utilized that is effective in reducing the number of fog centers generated during precipitation (and thereby minimum density in a photographic element employing the precipitated emulsion), it is an advantage of the invention that maintaining low pH during the addition of the oxidizing agent to starch peptized high bromide silver halide emulsion grains has been found to advantageously reduce the consumption rate of strong oxidizing agents which may be added to or generated in the precipitation reaction vessel such as bromine. This in turn has advantageously reduced the amount of oxidizing agent which must be added during the course of or after precipitation to achieve and maintain a desired high oxidation potential sufficient to oxidize silver metal fog centers which may be formed during precipitation, particularly internal fog centers, over any significant part of the precipitation process. In accordance with preferred embodiments of the invention, concentrations of oxidizing agent added to the emulsion are sufficient to provide an equivalent of from $1\times10^{-6}$ to $1\times10^{-3}$ mole elemental bromine per mole of precipitated silver halide, where the silver basis is the total silver at the conclusion of precipitation of the high bromide emulsion, regardless of whether the oxidizing agent is added during or after precipitation. The oxidizing agent may be added at the start of, or continuously or intermittently during precipitation of the high bromide emulsion grains, or after precipitation. In preferred embodiments, the oxidizing agent is added continuously, or as needed, during at least a significant part (e.g., 10 mole percent, based on total silver) of the precipitation to maintain an oxidation potential of at least 650 mV (Ag/AgCl ref.), i.e. sufficient to oxidize internal silver centers in the emulsion grains as they are formed, preferably within the last 50 mole percent of precipitation or after precipitation.

High bromide emulsions grains prepared in accordance with preferred embodiment of the invention may comprise tabular grains, wherein starch (preferably cationic) is substituted for gelatin in conventional emulsion grain precipitation processes. A summary of tabular grain emulsions is contained in *Research Disclosure*, Item 38957, cited above, I. Emulsion grains and their preparation, B. Grain morphology, particularly sub-paragraphs (1) and (3). In a particularly preferred embodiment, the invention is directed towards the preparation high bromide {111} tabular grain emulsions, wherein a water dispersible cationic starch is present during the precipitation (during nucleation and grain growth or during grain growth) of high bromide {111} tabular grains. High bromide {111} tabular grain emulsions are those in which greater than 50 percent of total grain projected area is accounted for by tabular grains having {111} major faces and containing greater than 50 mole percent bromide, based on silver.

The procedures for high bromide {111} tabular grain emulsion preparation through the completion of tabular grain growth require only the substitution of the selected peptizer for conventional gelatino-peptizers. The following high bromide {111} tabular grain emulsion precipitation procedures, here incorporated by reference, are specifically contemplated to be useful in the practice of the invention, subject to the selected peptizer, oxidizing agent and pH modifications discussed above:

Daubendiek et al U.S. Pat. No. 4,414,310;
Abbott et al U.S. Pat. No. 4,425,426;
Wilgus et al U.S. Pat. No. 4,434,226;
Maskasky U.S. Pat. No. 4,435,501;
Kofron et al U.S. Pat. No. 4,439,520;
Solberg et al U.S. Pat. No. 4,433,048;
Evans et al U.S. Pat. No. 4,504,570;
Yamada et al U.S. Pat. No. 4,647,528;
Daubendiek et al U.S. Pat. No. 4,672,027;
Daubendiek et al U.S. Pat. No. 4,693,964;
Sugimoto et al U.S. Pat. No. 4,665,012;
Daubendiek et al U.S. Pat. No. 4,672,027;
Yamada et al U.S. Pat. No. 4,679,745;
Daubendiek et al U.S. Pat. No. 4,693,964;
Maskasky U.S. Pat. No. 4,713,320;
Nottorf U.S. Pat. No. 4,722,886;
Sugimoto U.S. Pat. No. 4,755,456;
Goda U.S. Pat. No. 4,775,617;
Saitou et al U.S. Pat. No. 4,797,354;
Ellis U.S. Pat. No. 4,801,522;
Ikeda et al U.S. Pat. No. 4,806,461;
Ohashi et al U.S. Pat. No. 4,835,095;
Makino et al U.S. Pat. No. 4,835,322;
Daubendiek et al U.S. Pat. No. 4,914,014;
Aida et al U.S. Pat. No. 4,962,015;
Ikeda et al U.S. Pat. No. 4,985,350;
Piggin et al U.S. Pat. No. 5,061,609;
Piggin et al U.S. Pat. No. 5,061,616;
Tsaur et al U.S. Pat. No. 5,147,771;
Tsaur et al U.S. Pat. No. 5,147,772;
Tsaur et al U.S. Pat. No. 5,147,773;
Tsaur et al U.S. Pat. No. 5,171,659;
Tsaur et al U.S. Pat. No. 5,210,013;
Antoniades et al U.S. Pat. No. 5,250,403;
Kim et al U.S. Pat. No. 5,272,048;
Delton U.S. Pat. No. 5,310,644;
Chang et al U.S. Pat. No. 5,314,793;
Sutton et al U.S. Pat. No. 5,334,469;
Black et al U.S. Pat. No. 5,334,495;
Chaffee et al U.S. Pat. No. 5,358,840; and
Delton U.S. Pat. No. 5,372,927.

The high bromide {111} tabular grain emulsions that are formed in accordance with preferred embodiments of the invention preferably contain at least 70 (optimally at least 90) mole percent bromide, based on silver. Silver bromide, silver iodobromide, silver chlorobromide, silver iodochlorobromide, and silver chloroiodobromide tabular grain emulsions are specifically contemplated. Although silver chloride and silver bromide form grains in all proportions, chloride is preferably present in concentrations of 30 mole percent, based on silver, or less. Iodide can be present in the tabular grains up to its solubility limit under the conditions selected for tabular grain precipitation. Under ordinary conditions of precipitation silver iodide can be incorporated into the tabular grains in concentrations ranging up to about 40 mole percent, based on silver. It is generally preferred that the iodide concentration be less than 20 mole percent, based on silver. Typically the iodide concentration is less than 12 mole percent, based on silver. To facilitate rapid processing, such as commonly practiced in radiography, it is preferred that the iodide concentration be limited to less than 4 mole percent, based on silver. Significant photographic advantages can be realized with iodide concentrations as low as 0.5 mole percent, based on silver, with an iodide concentration of at least 1 mole percent, based on silver, being preferred.

The high bromide {111} tabular grain emulsions can exhibit mean grain ECD's of any conventional value, ranging up to 10 $\mu$m, which is generally accepted as the maximum mean grain size compatible with photographic utility. In practice, the tabular grain emulsions typically exhibit a mean ECD in the range of from about 0.2 to 7.0 $\mu$m. Tabular grain thicknesses typically range from about 0.03 $\mu$m to 0.3 $\mu$m. For blue recording somewhat thicker grains, up to about 0.5 $\mu$m, can be employed. For minus blue (red and/or green) recording, thin (<0.2 $\mu$m) tabular grains are preferred. The advantages that tabular grains impart to emulsions generally increases as the average aspect ratio or tabularity of the tabular grain emulsions increases. Both aspect ratio (ECD/t) and tabularity (ECD/$t^2$, where ECD and t are measured in $\mu$m) increase as average tabular grain thickness decreases. Therefore it is generally sought to minimize the thicknesses of the tabular grains to the extent possible for the photographic application. Absent specific application prohibitions, it is generally preferred that the tabular grains having a thickness of less than 0.3 $\mu$m (preferably less than 0.2 $\mu$m and optionally less than 0.07 $\mu$m) and accounting for greater than 50 percent (preferably at least 70 percent and optimally at least 90 percent) of total grain projected area exhibit an average aspect ratio of greater than 5 and most preferably greater than 8. Tabular grain average aspect ratios can range up to 100, 200 or higher, but are typically in the range of from about 12 to 80. Tabularities of >25 are generally preferred. High bromide {111} tabular grain emulsions precipitated in the presence of a cationic starch are disclosed in the following patents, the disclosures of which are here incorporated by reference: Maskasky U.S. Pat. Nos. 5,604,085, 5,620,840, 5,667,955, 5,691,131, and 5,733,718.

Preferably precipitation of high bromide emulsion grains in accordance with the invention is conducted by substituting a water dispersible cationic starch for all conventional gelatino-peptizers. In substituting the selected cationic starch peptizer for conventional gelatino-peptizers, the concentrations of the selected peptizer and the point or points of addition can correspond to those typically employed using gelatino-peptizers. In addition, it has been discovered that emulsion precipitation employing cationic starch peptizer can tolerate even higher concentrations of the selected peptizer than typically may be employed for gelatino-peptizers. For example, it has been observed that all of the selected peptizer required for the preparation of an emulsion through the step of chemical sensitization can be present in the reaction vessel prior to grain nucleation. This has the advantage that no peptizer additions need be interjected after tabular grain precipitation has commenced. It is generally preferred that from 1 to 500 grams (most preferably from 5 to 100 grams) of the selected peptizer per mole of silver to be precipitated be present in the reaction vessel prior to tabular grain nucleation. At the other extreme, it is, of course, well known, as illustrated by Mignot U.S. Pat. No. 4,334,012, here incorporated by reference, that no peptizer is required to be present during grain nucleation, and, if desired, addition of the selected peptizer can be deferred until grain growth has progressed to the point that peptizer is actually required to avoid tabular grain agglomeration.

Conventional dopants can be incorporated into the high bromide grains during their precipitation, as illustrated by the patents cited above and *Research Disclosure*, Item 38957, cited above, Section I. Emulsion grains and their preparation, D. Grain modifying conditions and adjustments, paragraphs (3), (4) and (5). It is specifically contemplated to incorporate shallow electron trapping (SET) site providing dopants in the grains, farther disclosed in *Research Disclosure*, Vol. 367, November 1994, Item 36736, and Olm et al U.S. Pat. No. 5,576,171, here incorporated by reference. Because starch is substantially free of nitrogen and sulfur containing material, which may form stable complexes with some metals, it may be possible in the absence of such complexing peptizers to more readily incorporate certain metals into the grains, e.g, platinum, palladium, iron, copper, and nickel compounds. Because some dopants may be subject to oxidative destruction, it may be preferred to delay the use of strong oxidizing agents during precipitation until after the dopants are incorporated.

It is also recognized that silver salts can be epitaxially grown onto the emulsion grains during the precipitation process. Epitaxial deposition onto the edges and/or comers of tabular grains, e.g., is specifically taught by Maskasky U.S. Pat. No. 4,435,501 and Daubendiek et al U.S. Pat. Nos. 5,573,902 and 5,576,168, here incorporated by reference.

Although epitaxy onto the host grains can itself act as a sensitizer, emulsions prepared in accordance with the invention can provide sensitivity enhancements with or without epitaxy when chemically sensitized employing one or a combination of noble metal, middle chalcogen (sulfur, selenium and/or tellurium) and reduction chemical sensitization techniques. Conventional chemical sensitizations by these techniques are summarized in *Research Disclosure*, Item 38957, cited above, Section IV. Chemical sensitizations. It is preferred to employ at least one of noble metal (typically gold) and middle chalcogen (typically sulfur) and, most preferably, a combination of both in preparing the emulsions of the invention for photographic use. The use of a cationic starch peptizer in accordance with preferred embodiments of the invention allows distinct advantages relating to chemical sensitization to be realized. Under comparable levels of chemical sensitization higher photographic speeds can be realized using cationic starch peptizers. When comparable photographic speeds are sought, a cationic starch peptizer in the absence of gelatin allows lower levels of chemical sensitizers to be employed and results in better incubation keeping. When chemical sensitizer levels remain unchanged, speeds equal to those obtained using gelatino-peptizers can be achieved at lower precipitation and/or sensitization temperatures, thereby avoiding unwanted grain ripening.

Between emulsion precipitation and chemical sensitization, the step that is preferably completed before any gelatin or gelatin derivative is added to the emulsion, it is conventional practice to wash the emulsions to remove soluble reaction by-products (e.g., alkali and/or alkaline earth cations and nitrate anions). If desired, emulsion washing can be combined with emulsion precipitation, using ultrafiltration during precipitation as taught by Mignot U.S. Pat. No. 4,334,012. Alternatively emulsion washing by diafiltration after precipitation and before chemical sensitization can be undertaken with a semipermeable membrane as illustrated by *Research Disclosure*, Vol. 102, October 1972, Item 10208, Hagemaier et al *Research Disclosure*, Vol. 131, March 1975, Item 13122, Bonnet *Research Disclosure*, Vol. 135, July 1975, Item 13577, Berg et al German OLS 2,436,461 and Bolton U.S. Pat. No. 2,495,918, or by employing an ion-exchange resin, as illustrated by Maley U.S. Pat. No. 3,782,953 and Noble U.S. Pat. No. 2,827,428. In washing by these techniques there is no possibility of removing the preferred cationic starch peptizers, since ion removal is inherently limited to removing much lower molecular weight solute ions. Further, it is often convenient to add gelatin to the emulsion after washing so that it can be chill set. In such case, it is preferable to add gelatin in the form of a solution that has been pre-adjusted to the desired low pH.

The starch peptized high bromide emulsion which are oxidized at low pH in accordance with the invention may be stored until they are chemically or spectrally sensitized. Copending, commonly assigned, concurrently filed U.S. Ser. No. 09/731,446, the disclosure of which is incorporated by reference, discloses that pH of less than 3.5 during precipitation and storage of starch peptized high bromide silver halide emulsions helps prevent generation of fog silver centers in emulsion grains. Accordingly, in preferred embodiments of the present invention, emulsions which have been oxidized with a strong oxidizing agent at low pH are preferably stored at a pH of less than 3.5, preferably less than or equal to 3.0, and more preferably less than or equal to 2.5 until they are chemically or spectrally sensitized. After sensitization, added dyes and conventional antifoggants may provide fog protection at conventional higher pH storage conditions of 5 and above.

A specifically preferred approach to chemical sensitization employs a combination of sulfur containing ripening agents in combination with middle chalcogen (typically sulfur) and noble metal (typically gold) chemical sensitizers. Contemplated sulfur containing ripening agents include thioethers, such as the thioethers illustrated by McBride U.S. Pat. No. 3,271,157, Jones U.S. Pat. No. 3,574,628 and Rosencrants et al U.S. Pat. No. 3,737,313. Preferred sulfur containing ripening agents are thiocyanates, illustrated by Nietz et al U.S. Pat. No. 2,222,264, Lowe et al U.S. Pat. No. 2,448,534 and Illingsworth U.S. Pat. No. 3,320,069. A preferred class of middle chalcogen sensitizers are tetra-substituted middle chalcogen ureas of the type disclosed by Herz et al U.S. Pat. Nos. 4,749,646 and 4,810,626, the disclosures of which are here incorporated by reference. Preferred compounds include those represented by the formula:

(III)

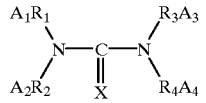

wherein

X is sulfur, selenium or tellurium;

each of $R_1$, $R_2$, $R_3$ and $R_4$ can independently represent an alkylene, cycloalkylene, alkarylene, aralkylene or heterocyclic arylene group or, taken together with the nitrogen atom to which they are attached, $R_1$ and $R_2$ or $R_3$ and $R_4$ complete a 5 to 7 member heterocyclic ring; and each of $A_1$, $A_2$, $A_3$ and $A_4$ can independently represent hydrogen or a radical comprising an acidic group, with the proviso that at least one $A_1R_1$ to $A_4R_4$ contains an acidic group bonded to the urea nitrogen through a carbon chain containing from 1 to 6 carbon atoms.

X is preferably sulfur and $A_1R_1$ to $A_4R_4$ are preferably methyl or carboxymethyl, where the carboxy group can be in the acid or salt form. A specifically preferred tetra substituted thiourea sensitizer is 1,3-dicarboxymethyl-1,3-dimethylthiourea.

Preferred gold sensitizers are the gold(I) compounds disclosed by Deaton U.S. Pat. No. 5,049,485, the disclosure of which is here incorporated by reference. These compounds include those represented by the formula:

$$AuL_2^+X^- \text{ or } AuL(L^1)^+X^- \quad \text{(IV)}$$

wherein

L is a mesoionic compound;

X is an anion; and $L^1$ is a Lewis acid donor.

In another preferred form of the invention it is contemplated to employ alone or in combination with sulfur sensitizers, such as those formula III, and/or gold sensitizers, such as those of formula IV, reduction sensitizers which are the 2-[N-(2-alkynyl)amino]-meta-chalcoazoles disclosed by Lok et al U.S. Pat. Nos. 4,378,426 and 4,451,557, the disclosures of which are here incorporated by reference.

Preferred 2-[N-(2-alkynyl)amino]-meta-chalcoazoles can be represented by the formula:

(V)

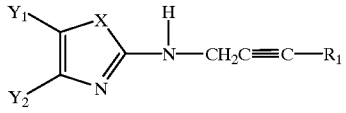

where

X=O, S, Se;

$R_1$=(Va) hydrogen or (Vb) alkyl or substituted alkyl or aryl or substituted aryl; and $Y_1$ and $Y_2$ individually represent hydrogen, alkyl groups or an aromatic nucleus or together represent the atoms necessary to complete an aromatic or alicyclic ring containing atoms selected from among carbon, oxygen, selenium, and nitrogen atoms.

The formula V compounds are generally effective (with the Vb form giving very large speed gains and exceptional latent image stability) when present during the heating step (finish) that results in chemical sensitization.

Starch peptized high bromide emulsions prepared in accordance with the invention may be advantageously employed with fragmentable electron donating sensitizers as described, e.g., in U.S. Pat. No. 6,090,536, and such emulsion may further be advantageously employed in photographic elements containing light scattering particles as described in U.S. Pat. No. 6,027,869, dye image enhancing couplers capable of releasing electron transfer agents as described in commonly assigned, copending U.S. Ser. No. 09/213,739, and one-equivalent dye-forming couplers as described in commonly assigned, copending U.S. Ser. No. 09/213,766, the disclosures of which are incorporated by reference herein. In addition, the high bromide grains may also be used in combination with conventional chemical and/or spectral sensitizers, and may also include one or more conventional antifoggants and stabilizers. A summary of conventional antifoggants and stabilizers is contained in *Research Disclosure*, Item 38957, VII. Antifoggants and stabilizers.

The starch-peptized emulsions of this invention can be used in otherwise conventional photographic elements comprising photographic emulsion layers coated on supports to serve varied applications including black-and-white and color photography, either as camera or print materials; image transfer photography; photothermography and radiography. Other sections of Research Disclosure, Item 38957 illustrate features particularly adapting the photographic elements to such varied applications.

The starch peptizer added during emulsion precipitation will typically form only a small portion of the total vehicle of a silver halide emulsion layer in a photographic element. Additional starch of the type used as a peptizer can be added to act as a binder. However, it is preferred to employ as binders other conventional hydrophilic colloid binders, particularly gelatin and gelatin derivatives. Maskasky U.S. Pat. No. 5,726,008, here incorporated by reference, describes a vehicle that can be chill set containing at least 45 percent by gelatin and at least 20 percent of a water dispersible starch. In addition to peptizer and binder, the vehicle is reacted with a hardener to increase its physical integrity as a coating and other addenda, such as latices, are also commonly incorporated. Conventional components which can be included within the vehicle of the emulsion layer summarized in *Research Disclosure*, Item 38957, II. Vehicles, vehicle extenders, vehicle-like addenda and vehicle related addenda and IX. Coating physical property modifying addenda—e.g., coating aids (such as surfactants), plasticizers and lubricants, matting agents and antistats are common vehicle components, conventional choices being illustrated by *Research Disclosure*, Item 38957, IX. Coating physical property modifying addenda.

Photographic element supports can take the form of any conventional support. Typically the support is either transparent (e.g., a transparent film support) or a white reflective support (e.g., a photographic paper support). A listing of photographic element supports is provided in *Research Disclosure*, Item 38957, XV. Supports.

Conventional incorporated dye image providing compounds that can be present in the emulsion layers are summarized in *Research Disclosure*, Item 38957, X. Dye image formers and modifiers. Preferred dye image providing compounds are image dye-forming couplers, illustrated in paragraph B. Dye image providing compounds can be incorporated directly into the emulsion layer or, less commonly, are coated in a conventional vehicle containing layer in reactive association with (usually contiguous to) an emulsion layer. Dye-forming couplers are commonly dispersed in hydrophilic colloid vehicles in high boiling coupler solvents or in latex particles. These and other conventional dispersing techniques are disclosed in paragraph D. Dispersing dyes and dye precursors.

Although *Research Disclosure*, Items 36544 and 38957, have been used to provide specific illustrations of conventional photographic element features as well as their exposure and processing, it is recognized that numerous other publications also disclose conventional features, including the following:

James *The Theory of the Photographic Process*, 4th Ed., Macmillan, New York, 1977;

*The Kirk-Othmer Encyclopedia of Chemical Technology*, John Wiley and Sons, New York, 1993;

Neblette's *Imaging Processes and Materials*, Van Nostrand Reinhold, New York 1988; and Keller, *Science and Technology of photography*, VCH, New York, 1993.

EXAMPLES

The invention can be better appreciated by reference to the following specific embodiments. Except as otherwise indicated, all weight percentages (wt %) are based on total weight. The suffix "C" is used to identify comparative Examples, which were not prepared in accordance with the invention.

Example 1

Starch Tabular-Grain AgIBr Emulsion, 4% I, Made at pH 2 and using Bromine as Oxidant A starch solution was prepared by heating at 80° C. for 30 min a stirred mixture of 8 kg distilled water and 160 g of an oxidized cationic starch (STA-LOK 140, obtained from A. E. Staley Manufacturing Co., Decatur, Ill., which is 100% amylopectin that had been treated to contain quaternary ammonium groups, 0.30–0.38 wt % nitrogen, and oxidized with 2 wt % chlorine bleach). After cooling to 40° C., the solution was made 6.56 mM in NaBr. The pH was adjusted to 2.0 with nitric acid and maintained at this value throughout the precipitation.

To the vigorously stirred reaction vessel containing the starch solution at 40° C. and pBr of 2.13, 2.0 mL of saturated bromine water was added. After holding for 5 min, solutions Sol-A (2.5 M $AgNO_3$) and Sol-B (2.5 M NaBr and 0.45 g/L Bromine) were added at 200 mL/min for 26 sec. After holding for 30 sec, Sol-B was added at 200 mL/min until the pBr reached 1.45. After holding for 30 sec, the temperature was increased to 60° C. at a rate of 1.67° C./min. After holding for 15 min at 60° C., Sol-A was added at 10 mL/min for 5 min while maintaining the pBr at 1.45 with Sol-B. Then the temperature was raised from 60 to 70° C. at 0.67° C./min and at the same time addition was started of Sol-A at 12 mL/min and Sol-B at 8 mL/min until the pBr reached 2.15. Sol-A was then accelerated from 10 mL/min to 30 mL/min in 90 min and Sol-B was added as needed to maintain a pBr of 2.15. Then Sol-A was added at 30 mL/min, and Sol-B was added as needed to maintain this pBr. The addition of Sol-A was stopped when a total of 2.24 L of Sol-A had been added and then the addition of Sol-B was increased to 100 mL/min until the pBr reached 1.28 at that point the addition of Sol-B was stopped. Solution Sol-C (0.32 M KI and 0.32 M NaBr) was added at 50 mL/min until 1 L had been added. After 1 min, Sol-A was added at 30 mL/min and when the pBr reached 2.37, Sol-B was concurrently added to maintain this pBr. The precipitation was stopped when a total of 8.0 moles of silver halide had been precipitated.

A total of 1.15 mmoles of bromine per mole Ag had been used. During the precipitation the oxidation potential was measured using a Pt measuring electrode and a Ag/AgCl reference electrodes connected to the vessel through a salt bridge filled with a 2.2M $KNO_3$, 0.4M $NaNO_3$ solution. The oxidation potential was above 650 mV during 85% of the precipitation and above 800 mV during 73% of the precipitation.

The emulsion was washed at 30° C. using ultrafiltration until the pBr reached 3.26. Then 1 L of a 21.6% bone gelatin solution was rapidly added with good stirring at 40° C. The mixture was adjusted at 40° C. to a pBr of 3.26 with NaBr sol. and a pH of 5.6 with $HNO_3$.

The resulting {111} tabular grain emulsion consisted of tabular grains having an average equivalent circular diameter of 2.7 μm, an average thickness of 0.124 μm, and an average aspect ratio of 22. The tabular grain population made up 99% of the total projected area. Analysis by transmission electron microscopy revealed that the grains with >10 edge and comer dislocations per grain were 86% of the tabular grain population.

Example 2C

Starch Tabular-Grain AgIBr Emulsion, 4% I, Made at pH 5 and using Bromine as Oxidant This emulsion was made similarly to that of Example 1, except that 29 mmoles of sodium acetate was added to the reaction vessel prior to the start of the precipitation, as a pH buffer, and the pH was maintained at 5.0 throughout the precipitation. A total of 1.15 mmoles of bromine per mole Ag was used. The oxidation potential was above 650 mV during 83% of the precipitation and above 800 mV during 39% of the precipitation.

The resulting {111} tabular grain emulsion consisted of tabular grains having an average equivalent circular diameter of 3.2 μm, an average thickness of 0.13 μm, and an average aspect ratio of 25. The tabular grain population made up 99% of the total projected area of the emulsion grains. Analysis by electron microscopy revealed that the grains with >10 edge and comer dislocations per grain were 88% of the tabular grain population.

Example 3C

Starch Tabular-Grain AgIBr Emulsion, 4% I, Made at pH 5 and without Oxidant

This emulsion was made similarly to that of Example 2C except that no bromine water was added to the starch solution and the NaBr solution Sol-B did not contain bromine (i.e., no bromine was used). The oxidation potential was never at or above 650 mV during the precipitation.

The resulting {111} tabular-grain emulsion consisted of tabular grains having an average equivalent circular diameter of 3.21 μm, an average thickness of 0.138 μm, and an average aspect ratio of 23. The tabular-grain population made up 99% of the total projected area of the emulsion grains.

Examples 4 and 5

NaOCl Solution Added as Needed to Maintain an Oxidation Potential of 820 mV, Precipitated at pH 2.0, and Stored at either pH 5.6 or 2.0

This pair of emulsions was made from a common emulsion that was split into two parts and stored at either pH 5.6 or 2.0. The primary emulsion was made similarly to that of Example 1, except that 1 mL of 1 M $HNO_3$ was added to 3.2 L of Sol-A, no bromine water was added to the starch solution, the NaBr solution Sol-B did not contain bromine, and a NaOCl solution having 0.145 wt % available chlorine was added as needed to initially establish and maintain an oxidation potential of 820 mV until its addition was temporarily stopped when a total of 2.24 L of Sol-A had been added. After Sol-C had been added and the pBr reached 1.52 during the addition of Sol-A, the addition of the NaOCl solution was resumed, but at a constant rate of 0.21 ml/min, resulting in an oxidation potential which rose but did not again exceed 700 mV. A total of the 75 g of NaOCl solution was used, comparable to 0.19 mmole $Br^{\circ}_2$/Ag mole in oxidation equivalents. The oxidation potential was above 650 mV during 76% of the precipitation and above 800 mV during 74% of the precipitation.

After washing, the emulsion was divided into two equal parts. To each part was added a 21.6% bone gelatin solution to make a gelatin-to-silver ratio of 27 g gel per mole silver. For Example 4, the bone gel solution and the final emulsion were adjusted to pH 5.6. For Example 5, the bone gel solution and the final emulsion were adjusted to pH 2.0 with $HNO_3$.

The resulting {111} tabular-grain emulsions consisted of tabular grains having an average equivalent circular diameter of 2.75 μm, an average thickness of 0.124 μm, and an average aspect ratio of 22. The tabular-grain population made up 99% of the total projected area.

Example 6

NaOCl Solution Added at a Continuous Rate, pH 3.0

This emulsion was made similarly to that of Example 1, except that the pH was maintained at 3.0 throughout the precipitation, no bromine water was added to the starch solution, the NaBr solution Sol-B did not contain bromine, and a NaOCl solution having 0.466 wt % available chlorine used. Initially, 6.5 mL of the NaOCl solution was added 2 min before the start of the precipitation and at a constant rate of 0.8 mL/min throughout the precipitation. A total of 174.0 g of NaOCl solution was added, equivalent to 1.43 mmol $Br^{o}_{2}$/Ag mol. The oxidation potential was above 800 mV during most of the precipitation.

The resulting {111} tabular grain emulsion consisted of tabular grains having an average equivalent circular diameter of 3.1 μm, an average thickness of 0.124 μm, and an average aspect ratio of 25. The tabular grain population made up 99% of the total projected area.

Example 7C

NaOCl Solution Added at a Continuous Rate, pH 5.0

This emulsion was made similarly to that of Example 6, except that 29 mmoles of sodium acetate was added to the reaction vessel prior to the start of the precipitation and the pH was maintained at 5.0 throughout the precipitation. A total of 179.5 g of NaOCl solution was added, equivalent to 1.47 mmol $Br^{o}_{2}$/Ag mol. The oxidation potential was above 650 mV during 83% of the precipitation and above 800 mV during 72% of the precipitation.

The resulting {111} tabular grain emulsion consisted of tabular grains having an average equivalent circular diameter of 3.0 μm, an average thickness of 0.123 μm, and an average aspect ratio of 24. The tabular grain population made up 99% of the total projected area.

Testing Emulsions for Fog

Portions of each of the emulsions were adjusted at 40° C. to pH 5.6, pBr 3.18, and then treated with gold. To the emulsion 6 mg/Ag mol of potassium tetrachloroaurate was added and the mixture was heated from 40 to 70° C. at a rate of 1.67° C./min, held at 70° C. for 20 min, and then cooled to 40° C. at a rate of 1.1° C./min. The resulting emulsion was coated on clear polyester support with 1.62 g/m$^2$ silver, 3.23 g/m$^2$ gelatin, surfactant, and hardener. A 2.69 g/m$^2$ gelatin layer was also coated over the emulsion layer. Portions of each emulsion in "primitive" form (i.e., not treated with gold) were also coated.

For photographic evaluation, each of the emulsion coatings was exposed for 0.1 sec to a 365 nm emission line of a Hg lamp filtered through a Kodak Wratten filter number 18A and a step wedge ranging in density from 0 to 4 density units in 0.2 density steps. The exposed coatings were given four different development treatments: Kodak Rapid X-Ray Developer (KRX) or Kodak Rapid X-Ray Developer with 0.5 g/L of added KI (KRX+KI) processing, with or without a prior treatment in Fe surface bleach (3 g potassium ferricyanide and 12.5 mg phenosafranine/liter). Fog (minimum density) data obtained for the various example emulsion coatings are presented in Table I below.

This fog test is based on the observation that gold only sensitization will cause latent fog centers (silver metal centers) of primitive emulsions to become developable, i.e., detectable. The test can be used as a means of distinguishing emulsions that would have elevated fog levels when chemically sensitized in attempting to achieve maximal photographic speed-fog performance. Heating a liquid emulsion with a Au sensitizing salt (Au only sensitization) amplifies any emulsion fog. Treating a coating of the Au-treated emulsion with surface bleach prior to development will lower surface fog and can enhance internal fog centers if present or even generate internal fog if the surface fog level is extensive (presumably by releasing electrons into the grain). For AgIBr emulsions, KRX is primarily (but not exclusively) a developer of surface image, while KRX+KI is a developer of both surface and internal silver.

Since both surface and internal silver centers can have an adverse effect on emulsion photographic performance, testing for total fog is important. Separating the Au enhanced fog into its location i.e., surface or internal, is difficult, unreliable and, for these emulsions, unnecessary. The relative fogging propensity for a series of emulsions can be determined from Au-treated emulsions by comparing each average Au-enhanced fog level value. This value is obtained by taking the average of the four fog values obtained from development in KRX or KRX+KI, with and without prior surface bleach treatment. Comparisons of the average Au-enhanced fog level shows those emulsions having the fewest number and/or smallest size of silver centers introduced during precipitation, subsequent handling, and storage.

TABLE I

| | | | | Fog Level (Minimum Density) | | | | |
|---|---|---|---|---|---|---|---|---|
| Example | pH | Oxidizing Agent | Gold Treatment | KRX | Bleach, KRX | KRX – KI | Bleach, KRX – KI | Average |
| 1 | 2 | Bromine | No | 0.036 | 0.056 | 0.023 | 0.022 | |
| (Invention) | | | Yes | 0.080 | 0.063 | 0.310 | 0.345 | 0.200 |
| 2C | 5 | Bromine | No | 0.035 | 0.066 | 0.035 | 0.034 | |
| (Control) | | | Yes | 0.128 | 0.065 | 0.280 | 0.387 | 0.215 |
| 3C | 5 | none | No | 0.032 | 0.056 | 0.066 | 0.054 | |
| (Control) | | | Yes | 0.396 | 0.117 | 0.344 | 0.325 | 0.296 |
| 4 | 2 | NaOCl | No | 0.038 | 0.073 | 0.027 | 0.025 | |
| (Invention) | | (820 mV) | Yes | 0.065 | 0.071 | 0.163 | 0.181 | 0.120 |
| 5 | 2 | NaOCl | No | 0.037 | 0.073 | 0.024 | 0.021 | |
| (Invention) | | (820 mV) | Yes | 0.065 | 0.068 | 0.099 | 0.096 | 0.082 |

TABLE I-continued

| Example | pH | Oxidizing Agent | Gold Treatment | Fog Level (Minimum Density) KRX | Bleach, KRX | KRX – KI | Bleach, KRX – KI | Average |
|---|---|---|---|---|---|---|---|---|
| 6 | 3 | NaOCl | No | 0.038 | 0.068 | 0.065 | 0.051 | |
| (Invention) | | | Yes | 0.075 | 0.068 | 0.211 | 0.293 | 0.162 |
| 7C | 5 | NaOCl | No | 0.038 | 0.068 | 0.063 | 0.037 | |
| (Control) | | | Yes | 0.658 | 0.308 | 0.477 | 0.417 | 0.465 |

The control emulsion, Example 2C, precipitated at pH 5 and using bromine, is a repeat of an emulsion that is known to give good photographic performance. The average Au fog level value was 0.215. The control emulsions Examples 3C and 7C, both made at pH 5, gave inferior average Au fog level values of 0.296 and 0.465 respectively and therefore would be more difficult to effectively chemical sensitize due to rapid fog growth during chemical sensitization and would give poor photographic performance. The remaining four emulsions were made at low pH in accordance with the invention. At pH less than 4.0, preferably less than or equal to 3.0, the rate of bromine reaction with the starch was found to be slower allowing a slower replenishment rate during emulsion making. Examples 4 and 5, e.g., used just 17% the amount of oxidant that was used to make control Example 2C, and still gave significantly improved Au fog levels compared to the control emulsion.

Control Example 7C and invention Examples 4, 5 and 6 used NaOCl as the oxidant. At pH less than 4.0, preferably less than or equal to 3.0, added NaOCl forms bromine in the reaction vessel due to the oxidation of bromide ion at low pH, and also the rate of reaction of the oxidizing agents with the starch is reduced. The three invention Examples 4, 5 and 6 emulsions gave significantly lower average Au fog than the control Example 7C emulsion made at pH 5.0. Particularly noteworthy are Examples 4 and 5, because bromine was not directly added to the reaction vessel thereby improving safety in manufacturing, and they were made using considerably less oxidant than the two control emulsions that were made with oxidant Oust 17% of Example 2C and just 13% of Example 7C control emulsions).

Invention Example 5 emulsion shows a further improvement in fog by storage at pH less than 4.0, preferably less than or equal to 3.0. The average gold fog level for Example 5 stored at pH 2.0 was 0.082, while that of Example 4 stored at pH 5.6 was 0.120.

Making starch peptized emulsions in the pH range of less than 4 has allowed significant improvement in fog control while at the same time permitted lowering oxidant levels and the need to directly handle dangerous elemental bromine. The low pH starch making process is possible due to two improved properties of starch compared to gelatin: its slower reaction rate with bromine at low pH and its slower rate of hydrolysis at low pH. Storage of the washed emulsions at refrigerator temperature, preferably containing added gelatin to permit chill-setting, at pH less than 3.5, preferably less than or equal to 3.0, results in a further improvement in fog reduction.

The invention has been described in detail with particular reference to certain preferred embodiments thereof, but it will be understood that variations and modifications can be effected within the spirit and scope of the invention.

What is claimed is:

1. A process for precipitating a high bromide silver halide emulsion in an aqueous medium comprising precipitating high bromide radiation-sensitive silver halide grains in reaction vessel by the reaction of soluble halide salt and a soluble silver salt in the presence of a peptizer comprising a water dispersable starch, wherein a strong oxidizing agent is added to the reaction vessel during or after the precipitation at a pH of less than 4.0 such that an oxidation potential of at least 650 mV (Ag/AgCl ref.) is achieved.

2. A process according to claim 1, wherein (a) the radiation-sensitive silver halide grains include tabular grains (1) having {111} major faces, (2) containing greater than 50 mole percent bromide, based on silver, and (3) accounting for greater than 50 percent total grain projected area, and (b) the peptizer is a water dispersible cationic starch.

3. A process according to claim 2 wherein the cationic starch is a water dispersible oxidized cationic starch.

4. A process according to claim 2 wherein the cationic starch contains α-D-glucopyranose repeating units and, on average, at least 1 percent of the α-D-glucopyranose repeating units are ring opened by oxidation.

5. A process according to claim 2, wherein the oxidizing agent is added at a pH of from 1.0 to 3.0.

6. A process according to claim 2, wherein the oxidizing agent is added at a pH of from 1.0 to 2.5.

7. A process according to claim 2, wherein the oxidizing agent is added at a pH of from 1.0 to 2.0.

8. A process according to claim 2, wherein the oxidizing agent comprises elemental bromine or a bromine-generating agent.

9. A process according to claim 8, wherein the bromine-generating agent comprises a hypochlorite ion salt.

10. A process according to claim 8, wherein an equivalent of from $1\times10^{-6}$ to $1\times10^{-3}$ mole elemental bromine per mole of precipitated silver halide is added to the reaction vessel.

11. A process according to claim 8, wherein the oxidizing agent is added continuously during precipitation of at least 10 mol percent of the high bromide emulsion grains.

12. A process according to claim 8, wherein the oxidizing agent is added as needed to maintain an oxidation potential of at least 650 mV (Ag/AgCl ref.) during precipitation of at least 10 mol percent of the high bromide emulsion grains.

13. A process according to claim 2 wherein the strong oxidizing agent is added to the reaction vessel at a pH of less than 4.0 after the precipitation is completed such that an oxidation potential of at least 650 mV (Ag/AgCl ref.) is achieved.

14. A process according to claim 2, further comprising chemically sensitizing the precipitated silver halide grains, wherein the emulsion is stored at a pH of less than 3.5 between precipitation and chemical sensitization.

15. A process according to claim 1 wherein the starch is a water dispersible cationic starch.

16. A process according to claim 1 wherein the starch contains α-D-glucopyranose repeating units and, on average, at least 1 percent of the α-D-glucopyranose repeating units are ring opened by oxidation.

17. A process according to claim 1, wherein the oxidizing agent is added at a pH of from 1.0 to 3.0.

18. A process according to claim 1, wherein the oxidizing agent is added at a pH of from 1.0 to 2.5.

19. A process according to claim 1, wherein the oxidizing agent is added at a pH of from 1.0 to 2.0.

20. A process according to claim 1, wherein the oxidizing agent comprises elemental bromine or a bromine-generating agent.

21. A process according to claim 1, wherein the bromine-generating agent comprises a hypochlorite ion salt.

22. A process according to claim 1, wherein an equivalent of from $1\times10^{-6}$ to $1\times10^{-3}$ mole elemental bromine per mole of precipitated silver halide is added to the reaction vessel.

23. A process according to claim 1, wherein the oxidizing agent is added continuously during precipitation of at least 10 mol percent of the high bromide emulsion grains.

24. A process according to claim 1, wherein the oxidizing agent is added as needed to maintain an oxidation potential of at least 650 mV (Ag/AgCl ref.) during precipitation of at least 10 mol percent of the high bromide emulsion grains.

25. A process according to claim 1 wherein the strong oxidizing agent is added to the reaction vessel at a pH of less than 4.0 after the precipitation is completed such that an oxidation potential of at least 650 mV (Ag/AgCl ref.) is achieved.

26. A process according to claim 2, further comprising chemically sensitizing the precipitated silver halide grains, wherein the emulsion is stored at a pH of less than 3.5 between precipitation and chemical sensitization.

27. A high bromide silver halide photographic emulsion comprised of (a) high bromide radiation-sensitive silver halide grains, and (b) peptizer for the silver halide grains comprising a water dispersable starch, wherein the radiation sensitive silver halide grains have been precipitated in a reaction vessel by the reaction of soluble halide salt and a soluble silver salt in the presence of the starch peptizer, and a strong oxidizing agent has been added to the reaction vessel during or after the precipitation at a pH of less than 4.0 such that an oxidation potential of at least 650 mV (Ag/AgCl ref.) was achieved.

28. An emulsion according to claim 27, stored at a pH of less than 3.5.

* * * * *